United States Patent [19]

Perkins

[11] 4,273,276

[45] Jun. 16, 1981

[54] HOLSTER WITH ADJUSTABLE SAFETY STRAP

[75] Inventor: Neale A. Perkins, Bradbury, Calif.

[73] Assignee: Safariland Ltd. Inc., Monrovia, Calif.

[21] Appl. No.: 98,984

[22] Filed: Nov. 30, 1979

[51] Int. Cl.[3] ..... F41C 33/02

[52] U.S. Cl. ..... 224/243; 24/208 R; 150/7; 224/911; 229/78 A

[58] Field of Search ..... 224/236–238, 224/242–244, 911; 150/7, 43; 229/65, 78 A; 24/208 R, 208 A

[56] References Cited

U.S. PATENT DOCUMENTS

| | | | |
|---|---|---|---|
| 1,953,852 | 4/1934 | Gray | 229/78 A |
| 3,032,244 | 5/1962 | Zeabari | 224/242 |
| 3,252,639 | 5/1966 | Sloan | 224/911 X |
| 3,294,135 | 12/1966 | Brenner | 150/7 X |
| 4,076,156 | 2/1978 | Katz | 224/243 |
| 4,143,798 | 3/1979 | Perkins | 224/243 |

*Primary Examiner*—Stephen Marcus

*Attorney, Agent, or Firm*—Christie, Parker & Hale

[57] ABSTRACT

A holster includes a safety strap which extends over a firearm carried in the holster. An adjustable snap ring fastener on an inside face of the holster attaches to a fastener on the end of the safety strap for securing the safety strap over the hammer of the firearm. The adjustable snap ring fastener overlies a narrow, elongated opening in the wall of the holster, and an adjustment screw of the inside face of the holster releasably secures the snap ring fastener over the opening. The adjustment screw is fastened to a bushing on the outside face of the holster. The adjustment screw can be loosened to permit sliding movement of the snap ring fastener to a selected position on the holster. A thin metal reinforcing member fastened to the outside face of the holster has a narrow, elongated opening that registers with the elongated opening in the wall of the holster. Sliding movement of the snap ring fastener is guided by the bushing which rides in the elongated opening of the reinforcing member. The position of the snap ring fastener can be adjusted on the holster to compensate for the softening or stretching of the leather in the safety strap, or to allow the safety strap to adjust for the hammer height of different firearms.

10 Claims, 8 Drawing Figures

HOLSTER WITH ADJUSTABLE SAFETY STRAP

BACKGROUND

This invention relates to holsters, and more particularly to an improved safety strap for holsters.

Holsters commonly have a safety strap for holding a firearm in the holster. Safety straps typically extend over the hammer or across the frame of the firearm, and a snap ring fastener on the safety strap is releasably secured to a cooperating snap ring fastener on the holster. In many holsters the female snap ring fastener is located on an upward extension of the holster side wall, and the cooperating male snap ring fastener is located on the end of the safety strap. The extension at the top of the holster is often referred to as a "thumb break," inasmuch as thumb pressure can be exerted outwardly on the thumb break to unsnap the safety strap prior to drawing the firearm from the holster. This assumes that the safety strap is held in a taut position over the firearm when fastened to the fastener on the thumb break. However, the leather in the safety strap softens and stretches with time, which can make the safety strap so loose that it will not unsnap when pressure is exerted on the thumb break. Sometimes a safety strap stretches so much that the firearm can come out of the holster without unsnapping the fastener on the safety strap.

The present invention overcomes these disadvangates by compensating for the stretching or softening of the leather in the safety strap, so that the safety strap can always be held tightly over the hammer of the firearm.

SUMMARY OF THE INVENTION

Briefly, the invention includes a holster having a safety strap and a snap ring fastener secured to a wall of the holster for releasably holding the safety strap over a firearm in the holster. A narrow, elongated opening formed in the wall of the holster extends toward the portion of the holster where the firearm is carried. A snap ring fastener element on one face of the holster overlies the opening in the wall of the holster. A movable attachment element on the opposite face of the holster overlies the opening in the wall of the holster. A fastener releasably secures the snap ring fastener element to the movable attachment element. The fastener can be loosened for moving the snap ring fastener element and the attachment member as a unit to a selected position along the length of the elongated opening. The fastener is then tightened to hold the snap ring fastener element in the selected position.

In one embodiment, movement of the attachment member and the snap ring fastener element is guided along the opening in the side wall of the holster. Such guided movement is provided by a reinforcing member rigidly secured to the wall of the holster. A narrow, elongated opening in the reinforcing member registers with the opening in the holster. A protruding shoulder on the attachment member slidably engages opposite sides of the opening in the reinforcing member for guiding movement of the attachment member back and forth along the opening in the reinforcing member.

Thus, as the leather in the safety strap stretches during use, the snap ring fastener element can be moved to a new position on the holster to compensate for the stretching of the safety strap, so that the safety strap can be held taut over the hammer of the firearm.

The invention also makes it possible to provide a holster that can fit a number of different firearms. Holsters are usually made for one particular firearm, and the hammer height can vary with different firearms. The adjustable position of the safety strap fastener enables different firearms to be used with the same holster, since the position of the safety strap fastener can be adjusted to accommodate variations in the hammer height of different firearms.

These and other aspects of the invention will be more fully understood by referring to the following detailed description and the accompanying drawings.

DRAWINGS

DETAILED DESCRIPTION

Figure 1:
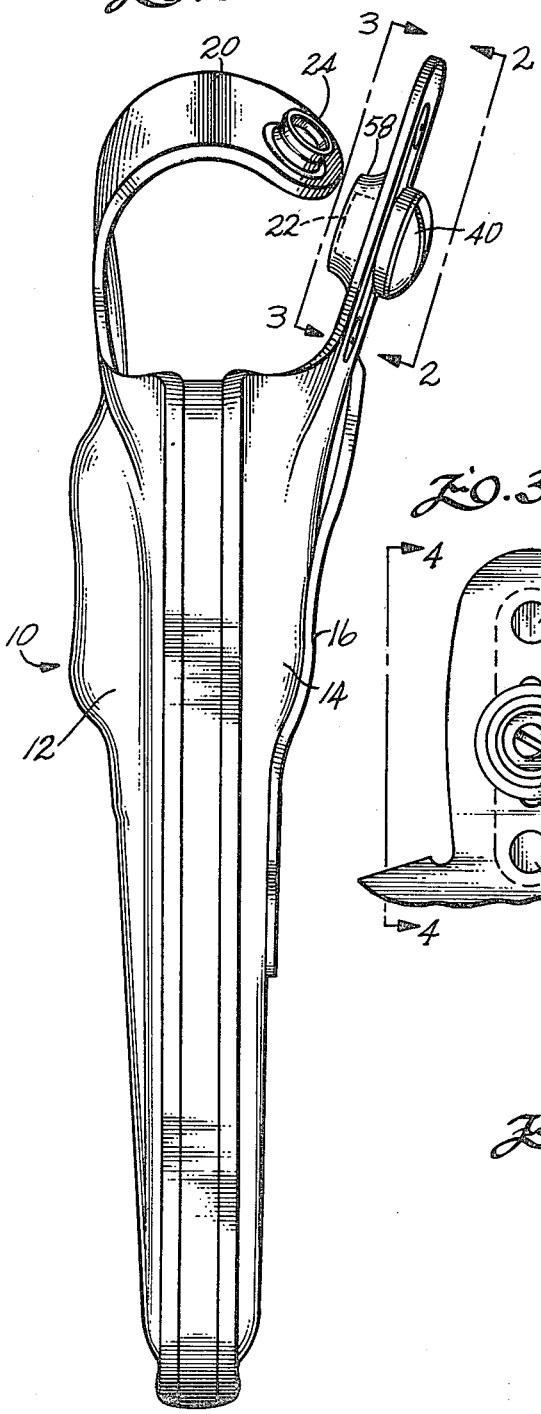
FIG. 1 is an end elevation view showing a holster with an adjustable safety strap fastener according to principles of this invention.
Figure 2:
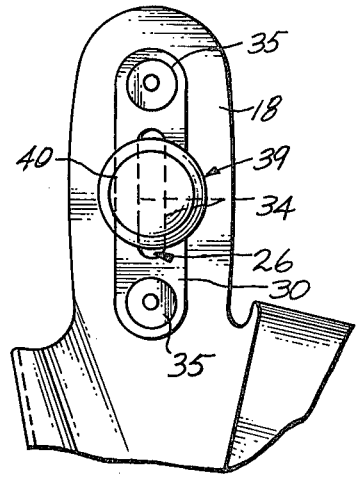
FIG. 2 is a fragmentary side elevation view taken on line 2—2 of FIG. 1.
Figure 3:
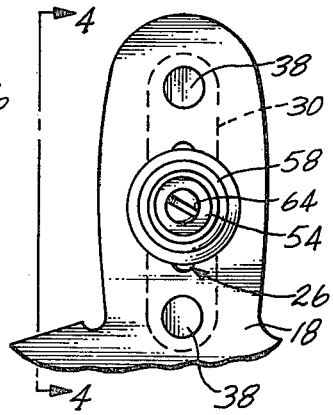
FIG. 3 is a fragmentary side elevation view taken on line 3—3 of FIG. 1.
Figure 4:
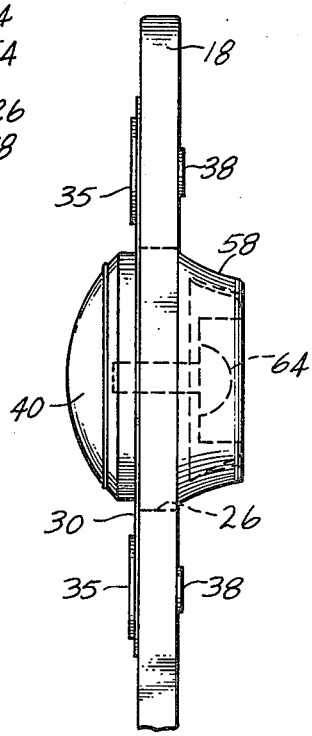
FIG. 4 is a fragmentary end elevation view taken on line 4—4 of FIG. 3.
Figure 5:
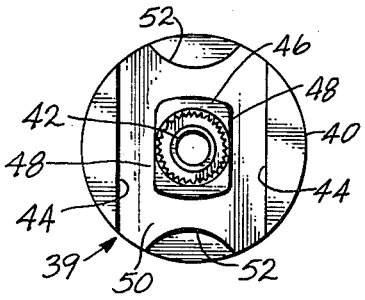
FIG. 5 is a side elevation view of a bushing for attaching the fastener to the holster.
Figure 6:
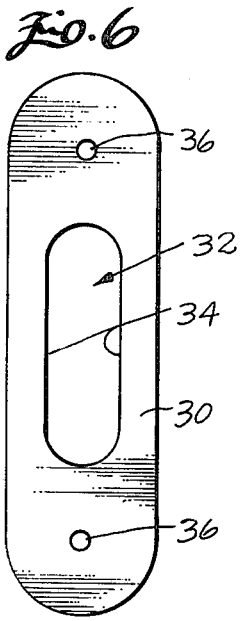
FIG. 6 is a side elevation view showing a reinforcing member used in attaching the fastener to the holster.

Referring to the drawings, a holster 10 includes a pair of outside and inside leather panels 12 and 14, respectively, secured together by stitching at oppostie ends of the panels. A firearm (not shown) is carried in the hollow interior formed in the holster between the panels. The holster is worn by a belt (not shown) threaded through a belt loop formed by a leather piece 16 stitched to the inside panel of the holster. Both panels can be pressure molded to match the contour of the firearm. This enables the firearm to make a snug fit inside the holster.

An upwardly extending projection 18 of the inside panel 14 forms a thumb break extending above the hammer of the firearm. The outside panel 12 has a safety strap 20 that loops over the hammer of the firearm and, in use, terminates adjacent the face of the thumb break. A female snap ring fastener 22 is secured to the thumb break, and a male snap ring fastener 24 is secured to an end portion of the safety strap 20. In use, the male and female snap ring fasteners are releasably snapped together to hold the safety strap over the hammer of the firearm. The snap ring fasteners can be released by thumb pressure exerted on the thumb break in an outward direction away from the safety strap to free the safety strap prior to removing the firearm from the holster.

This invention provides means for selectively adjusting the position of the snap ring fastener 22 along the length of the thumb break. This means of adjustment is provided by a narrow, elongated opening 26 formed along the longitudinal axis of the thumb break. Parallel straight edges 28 extend along opposite sides of the opening 26 in the thumb break. The opening in the thumb break is generally parallel to the length of the interior region of the holster. In one embodiment, the opening 26 can be about one inch long, to provide a one inch long travel for the female snap ring fastener along the length of the thumb break.

An elongated reinforcing member 30, preferably a strip of thin clock spring steel, overlies the outside face of the thumb break. The reinforcing member has a narrow, elongated opening 32 extending centrally along its long axis. The opening 32 in the reinforcing member is preferably the same size and shape as the opening 26 in the thumb break. The reinforcing member overlies the outside face of the thumb break so that its opening 32 registers with the opening 26 in the thumb break. Thus, the elongated opening in the reinforcing member has parallel straight edges 34 which extend generally parallel to the long side edges of the opening in the reinforcing member. The reinforcing member thereby reinforces the outer edges of the elongated opening in the holster. The reinforcing member is rigidly secured to the thumb break by a pair of rivets 35 which extend through holes 36 adjacent opposite ends of the reinforcing member and through corresponding holes 37 in the thumb break. The shank portion of each rivet is press-fitted into a receptacle of a corresponding T-nut 38 on the inside face of the thumb break.

An attachment element in the form of a bushing 39 secures the female snap ring fastener 22 to the thumb break. The bushing comprises a transversely circular solid fastener head or body 40 preferably made of plastic. The bushing is much larger than the width, or narrow dimension of the elongated openings in the thumb break and the reinforcing member. The bushing has a relatively flat inside face for overlying the outside face of the thumb break. A generally centrally located, internally threaded bronze fastener element 42 is embedded in the bushing so as to face outwardly from the inside face of the bushing. A pair of spaced apart, parallel, straight relief edges 44 are recessed in the inside face of the bushing and extend along opposite sides of the internally threaded fastener element 42. The fastener element 42 faces outwardly through an outwardly protruding boss 46 in the center of the bushing. The boss 46 surrounds the fastener element. A pair of spaced apart, parallel, straight side edges 48 extend along opposite sides of the boss, and therefore along opposite sides of the fastener element 42. The opposite side edges 48 of the boss are equidistantly spaced from and extend generally parallel to the releif edges 44. Thus, a relief area 50 with a flat recessed face is provided in the central region of the bushing inside the relief edges 44 and surrounding the projecting boss 46 and the fastener element 42. The inside face of the bushing also includes opposite relief areas 52 that are recessed even more than the relief area 50. These opposite relief area provide thinned-down areas to facilitate gripping opposite sides of the bushing when loosening or tightening it during use, as described below.

Figure 7:
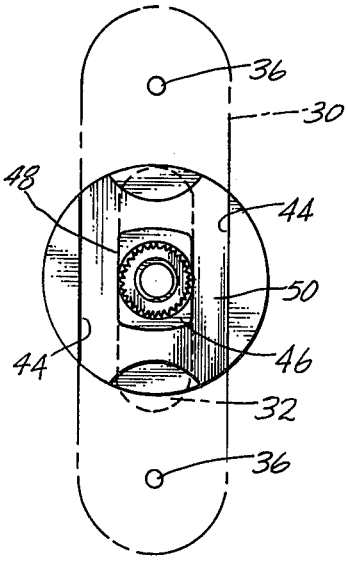
FIG. 7 is a side elevation view showing the bushing mounted for guided movement along the reinforcing member.
Figure 8:
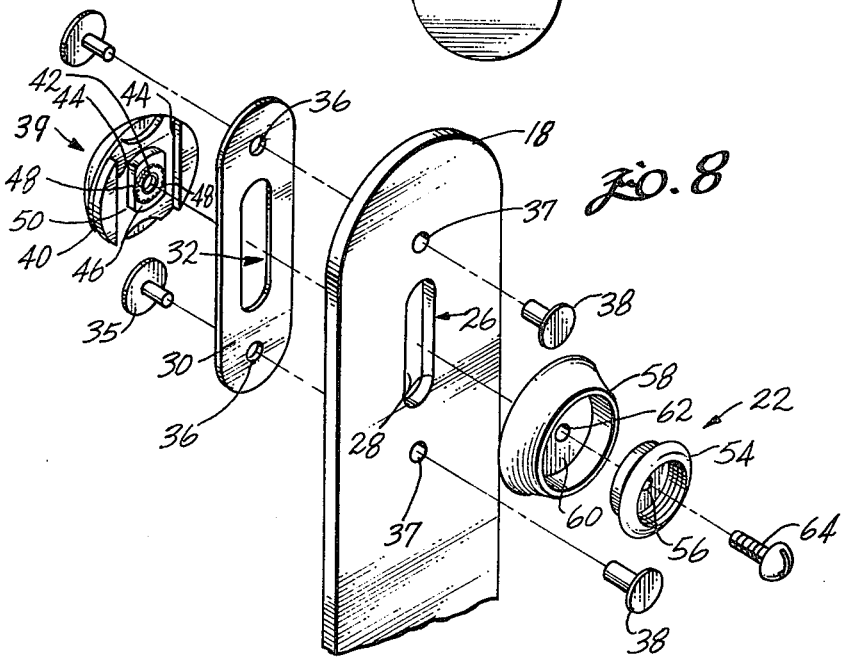
FIG. 8 is a fragmentary exploded perspective view showing means for adjustably fasteneing the snap ring fastener to the holster.

The inside face of the bushing is mounted over the reinforcing member 30, as shown in FIG. 7. The boss 44 on the bushing projects through the long central opening 32 in the reinforcing member; and the long, narrow parallel legs on opposite sides of the opening in the reinforcing member are recessed in the relief area 50 of the bushing. The outside edges of the reinforcing member abut against the outer relief edges 44 of the bushing; and simultaneously, the edges 34 along opposite sides of the opening in the reinforcing member abut against the outer edges 48 of the boss. This provides means for guiding travel of the bushing back and forth along the straight path provided by the opening in the reinforcing member and in the holster.

The female snap ring fastener is in the form of a circular metal receptacle 54. A circular bore 56 extends through the bottom wall of the receptacle. The interior of the receptacle 54 is configured so that the exterior surface of the male snap fastener 24 on the safety strap can be releasably snapped into engagement with the interior of the receptacle for fastening the end of the safety strap to the inside of the thumb break.

A circular shield 58 surrounds the entire outer surface of the receptacle 54. The shield is formed generally as a cup having a recessed interior 64 for holding the receptacle. The depth of the shield is such that the outer marginal edge of the shield projects into the interior of the holster beyond the outer lip of the receptacle when the receptacle is in the shield. Thus, when a firearm is withdrawn from the holster, any portion of the firearm which would otherwise contact the receptacle of the snap ring fastener instead contacts the shield. The shield is made from a material having a hardness less than that of the fastener receptacle, and is sufficiently soft that it will not abrade the firearm when contact occurs. The receptacle is described in greater detail in my U.S. Pat. No. 4,143,798, which is incorporated herein by this reference.

In mounting the receptacle to the inside face of the thumb break, the receptacle is inserted in the recessed region 60 of the shield, and the flat bottom surface of the shield is placed over the elongated opening 26 in the thumb break. A central hole 62 in the shield is registered with the opening in the thumb break, and the opening 56 in the receptacle is thereby automatically registered with the hole in the shield and the opening in the thumb break. On the opposite side of the thumb break, the internally threaded fastener element 42 of the bushing protrudes through the elongated opening 32 in the reinforcing member and extends into the opening in the thumb break. The holes 56 and 62 in the receptacle and shield are aligned with the fastener element 42. A fastener in the form of a screw 64 fastens the receptacle and shield to the bushing on the opposite side of the thumb break. The screw is tightened against the bottom face of the receptacle 54 to tightly secure the receptacle to the thumb break. The screw can be loosened to allow the receptacle, shield and bushing to be moved as a unit along the length of the opening in the thumb break to any selected position along the opening. The screw 64 then can be tightened to hold the receptacle in the selected position.

In using this means of adjustment the receptacle initially can be positioned near the top of the opening in the thumb break when the holster is new. As the leather in the safety strap softens and stretches with time, the position of the receptacle can be moved downwardly to a number of different positions along the length of the opening in the thumb break, to compensate for the longer length of the safety strap. Thus, the position of the receptacle 54 can always be changes so the safety strap can always be held in a tight position over the hammer of a firearm carried in the holster.

The reinforcing member provides (1) means for reinforcing and protecting the opening in the thumb break to reduce wear; (2) means for guiding the slide adjustment of the receptacle, and (3) means for securely holding the receptacle in its selected position, since the reinforcing member is a better means of support for the adjustment members than bare leather.

Thus, the holster of this invention ensures that the safety strap can always fit tightly over the hammer of a firearm to prevent the firearm from coming out of the holster without first unsnapping the safety strap. This also ensures that the safety strap can be unsnapped by applying outward pressure to the thumb break independently of the amount of stretching the safety strap undergoes during use.

In addition, the holster is more versatile because it can be used with different firearms, say those with different hammer configurations, since the position of the snap ring fastener can simply be adjusted to accommodate each hammer configuration. Thus, the useful life of the holster can be extended, and a dealer can effectively reduce inventory by fitting many more firearms with fewer holsters.

I claim:

1. In a holster for carrying a firearm and comprising a case having a safety strap for securing a firearm in the case, and a snap ring fastener element secured to a wall of the holster adjacent the case for use in holding the safety strap over the firearm, the improvement comprising:

a reinforcing member overlying the wall of the holster and having an elongated opening that registers with a similar elongated opening in the wall of the holster;

means securing the reinforcing member in a fixed position on the wall of the holster so the two elongated openings register with each other;

a snap ring fastener element adjacent the wall of the holster on a side thereof opposite the reinforcing member;

an attachment element facing the registered elongated openings in the reinforcing member and the wall of the holster; and fastening means engaging the attachment element to releasably secure the snap ring fastener element to the wall of the holster, the fastening means being releasable from the attachment element for moving the snap ring fastener element to a selected position along the length of the registered elongated openings, the fastening means being securely fastened to the attachment memeber to rigidly hold the fastener element in the selected position.

2. Apparatus according to claim 1 in which the attachment element and the fastening means comprise cooperating threaded fasteners for being released and tightened to allow the fasteningf element to be moved along the length of the elongated opening to a desired position and rigidly secured in the selected position.

3. Apparatus according to claim 1 in which the attachment element has guide means slidably disposed in the elongated opening of the reinforcing member for for guiding straight movement of the attachment member along the length of the opening in the reinforcing member.

4. Apparatus according to claim 3 in which the guide means includes a projecting shoulder on the attachment member for extending through the opening in the reinforcing member and engaging opposite edges of the opening.

5. Apparatus according to claim 4 including a complementary fastener on the shoulder of the attachment member for cooperating with the fastening means to releasably secure the snap ring fastening element to the wall of the holster.

6. Apparatus according to claim 1 including a shield on the side wall of the holster opposite the reinforcing member, the shield being made of a material having a hardness less than that of the snap ring fastener element; and the snap ring fastener element is disposed inside the shield for recessing the fastener element inside the shield; and the fastening means extends through the shield and secured the snap ring fastener element in the shield.

7. Apparatus according to claim 6 in which the shield and the snap ring fastener element are movable together along the length of the registered openings when the fastening means is released.

8. A holster for carrying a firearm comprising;

a case having a hollow interior for carrying a firearm, and an elongated safety strap for extending over a firearm to hold the firearm in the interior of the case;

a first snap ring fastener element secured to the safety strap;

a second snap ring fastener element secured to a wall of the holster for engaging the first snap ring fastener element to fasten the safety strap to the wall of the case;

a narrow, elongated opening in the wall of the holster and extending on a line toward the interior of the case;

an attachment member adjacent the wall of the holster on a side thereof opposite the second snap ring fastener element;

a fastener extending through the elongated opening in the holster and releasably securing the second snap ring fastener element to the attachment member, the fastener being releasable from attachment to the attachment member for permitting moving the second snap ring fastener element to a selected position along the length of the elongated opening, the fastener being securely fastened to the attachment member to rigidly hold the fastener element in said selected position; and means for guiding movement of the attachment member and the fastener on a straight path along the elongated opening when the fastener is released from attachment ot the attachment member.

9. Apparatus according to claim 8 in which the guide means includes an elongated reinforcing member with an elongated opening registered with the opening in the wall of the holster, and the attachment member is slidably disposed in the opening of the reinforcing member for guiding movement of the attachment member along the opening in the reinforcing member.

10. Apparatus according to claim 9 including a shield on the wall of the holster opposite the reinforcing member, the shield being made of a material having a hardness less than the second snap ring fastener element; and the second snap ring fastener element is disposed inside the shield for recessing it inside the shield; and the fastener extends through the shield and secures the second snap ring fastener element in the shield.

* * * * *